US012044491B2

(12) United States Patent
Turlakov

(10) Patent No.: US 12,044,491 B2
(45) Date of Patent: Jul. 23, 2024

(54) TURLAKOV'S RIFLE N 10 (FERLACH)

(71) Applicant: Maxim Turlakov, Ferlach (AT)

(72) Inventor: Maxim Turlakov, Ferlach (AT)

(73) Assignee: MAXIM TURLAKOV, Ferlach (AT)

( * ) Notice: Subject to any disclaimer, the term of this patent is extended or adjusted under 35 U.S.C. 154(b) by 0 days.

(21) Appl. No.: 17/927,888

(22) PCT Filed: May 18, 2021

(86) PCT No.: PCT/RU2021/000200

§ 371 (c)(1),
(2) Date: Nov. 27, 2022

(87) PCT Pub. No.: WO2021/242140

PCT Pub. Date: Dec. 2, 2021

(65) Prior Publication Data

US 2023/0204313 A1 Jun. 29, 2023

(30) Foreign Application Priority Data

May 29, 2020 (RU) ..... 2020117753

(51) Int. Cl.
*F41A 3/66* (2006.01)
*F41A 17/38* (2006.01)
*F41A 9/61* (2006.01)

(52) U.S. Cl.
CPC ..... *F41A 17/38* (2013.01); *F41A 3/66* (2013.01); *F41A 9/61* (2013.01)

(58) Field of Classification Search
CPC ..... F41A 17/38; F41A 3/66
USPC ..... 89/33.1; 42/6, 18
See application file for complete search history.

(56) References Cited

U.S. PATENT DOCUMENTS 232,880 A * 10/1880 Burton ..... F41A 17/38 42/18
417,595 A * 12/1889 Sneider ..... F41A 17/38 42/6
1,450,834 A * 4/1923 Bergmann ..... F41A 3/66 89/197
2,409,568 A * 10/1946 Johnson, Jr. ..... F41A 9/70 42/18
2,899,767 A * 8/1959 Boudreau ..... F41C 27/22 42/106
4,567,810 A * 2/1986 Preston ..... F41A 17/38 89/142
10,598,453 B2 * 3/2020 Underwood ..... F41A 9/83

FOREIGN PATENT DOCUMENTS

DE 3820943 C1 * 11/1989 ..... F41D 10/34

* cited by examiner

*Primary Examiner* — Reginald S Tillman, Jr.

(57) ABSTRACT

The invention relates to firearms and is aimed at improving the ergonomics of guns, by reducing the overall length and providing ease of the installation of the magazine.
These results are achieved by the fact, that the receptacle of the magazine is located above the trigger guard, and the magazine is placed in the receptacle of the magazine through the hole on the side surface of the firearm.

2 Claims, 6 Drawing Sheets

TURLAKOV'S RIFLE N 10 (FERLACH)

TECHNICAL FIELD

The invention relates to the field of gun's technology and can be used in firearm, mainly hunting.

BACKGROUND OF THE INVENTION

Known firearm U.S. Pat. No. 492,212A, containing on its side surface the hole through which the cartridges are placed in the receptacle of cartridges. The disadvantage of this design is the lack of the replaceable magazine and the long length of the firearm, due to the fact that the receptacle of the cartridge is located in the front of the trigger guard.

So is the design of the U.S. Pat. No. 3,509,654A design, where the magazine is placed above the trigger guard. The disadvantage of this design is the difficulty of placing cartridges in the firearm.

The U.S. Pat. No. 7,963,062B1 design has the magazine, located above the trigger guard, but this firearm has the disadvantage of being very difficult and inconvenient to handle the firearm.

DISCLOSURE OF THE INVENTION

The present invention solves the problem of reducing the length of the firearm and facilitating the installation of the magazine into the receptacle of the magazine.

To reduce the length of the firearm, it is proposed to place the magazine receiver above the trigger guard, and for the convenience of loading the firearm, it is proposed to make the hole on the side surface of the firearm through which the magazine is placed into the receptacle of the magazine.

BRIEF DESCRIPTION OF DRAWINGS

The essence of the invention is illustrated by sketches, where.

THE BEST EMBODIMENT OF THE INVENTION

Figure 1:
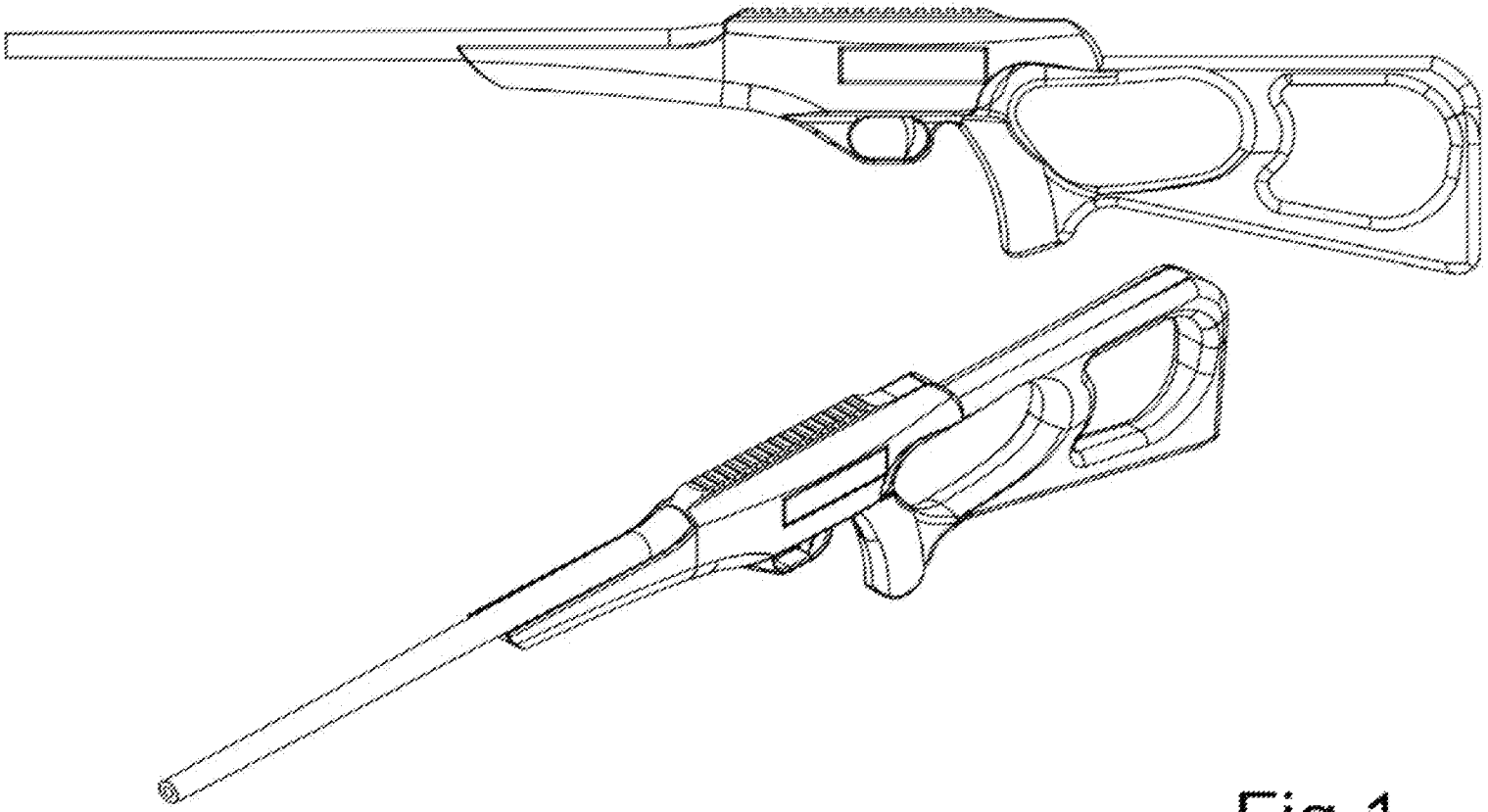
in FIG. 1—shows the appearance of the firearm.
Figure 3:
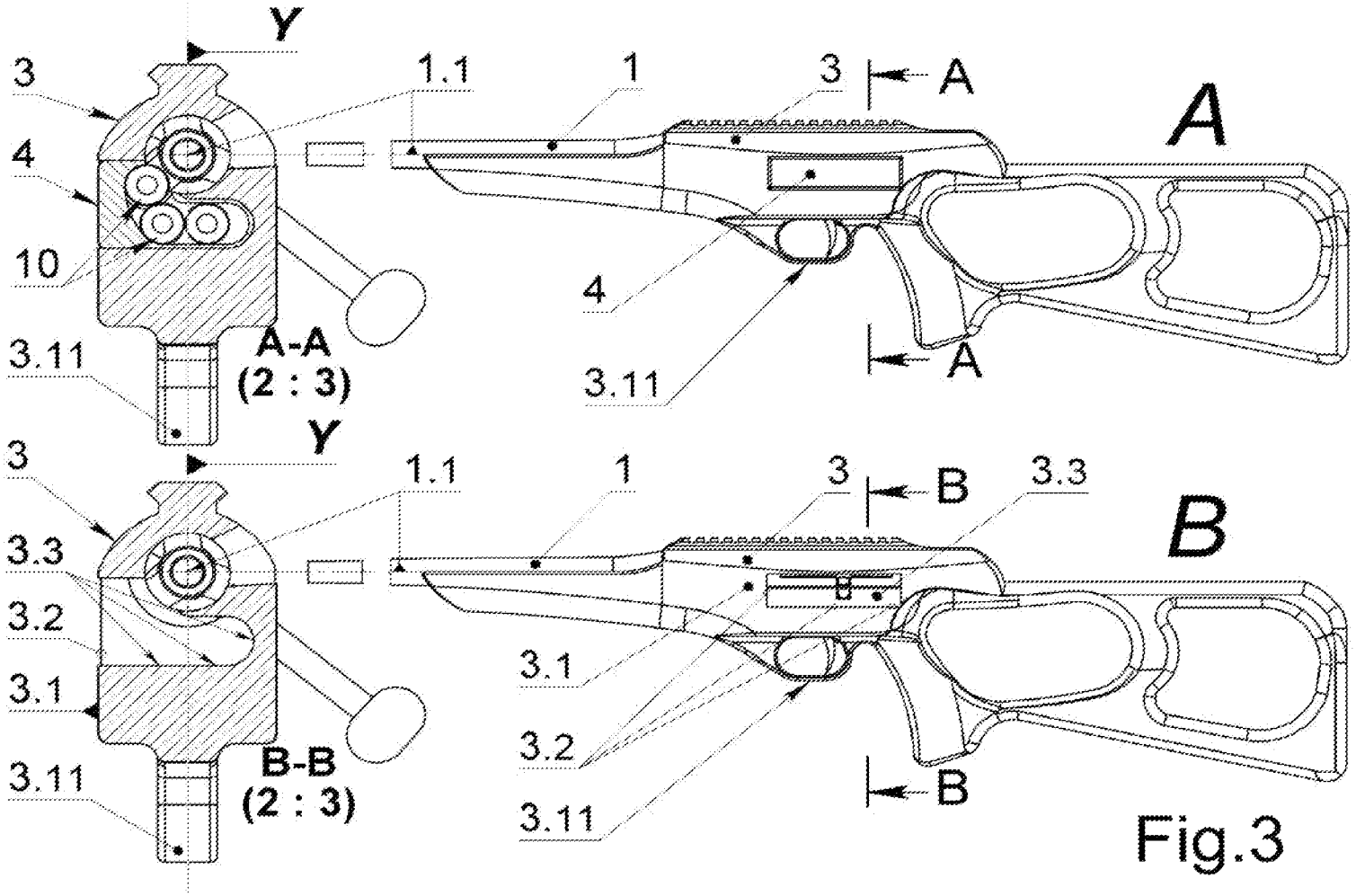
in FIG. 3—shows the proposed firearm with the placed in it magazine (view A), and without the magazine (view B), sections along A-A, B-B.

The proposed firearm (FIG. 1), containing the barrel 1 (FIG. 3, 4, 5), the receiver 3, the trigger 3.10, the trigger guard 3.11, the magazine 4 with cartridges 10, functions as follows:

The firearm (FIG. 3, view B and FIG. 4, section D-D) contains the receptacle of the magazine 3.3 located above the trigger guard 3.11. The side surface 3.1 of the firearm contains the hole 3.2 through which the magazine 4 (FIG. 2, view A and FIG. 4, view A, section D-D) is placed in to the receptacle of the magazine 3.3.

Figure 2:
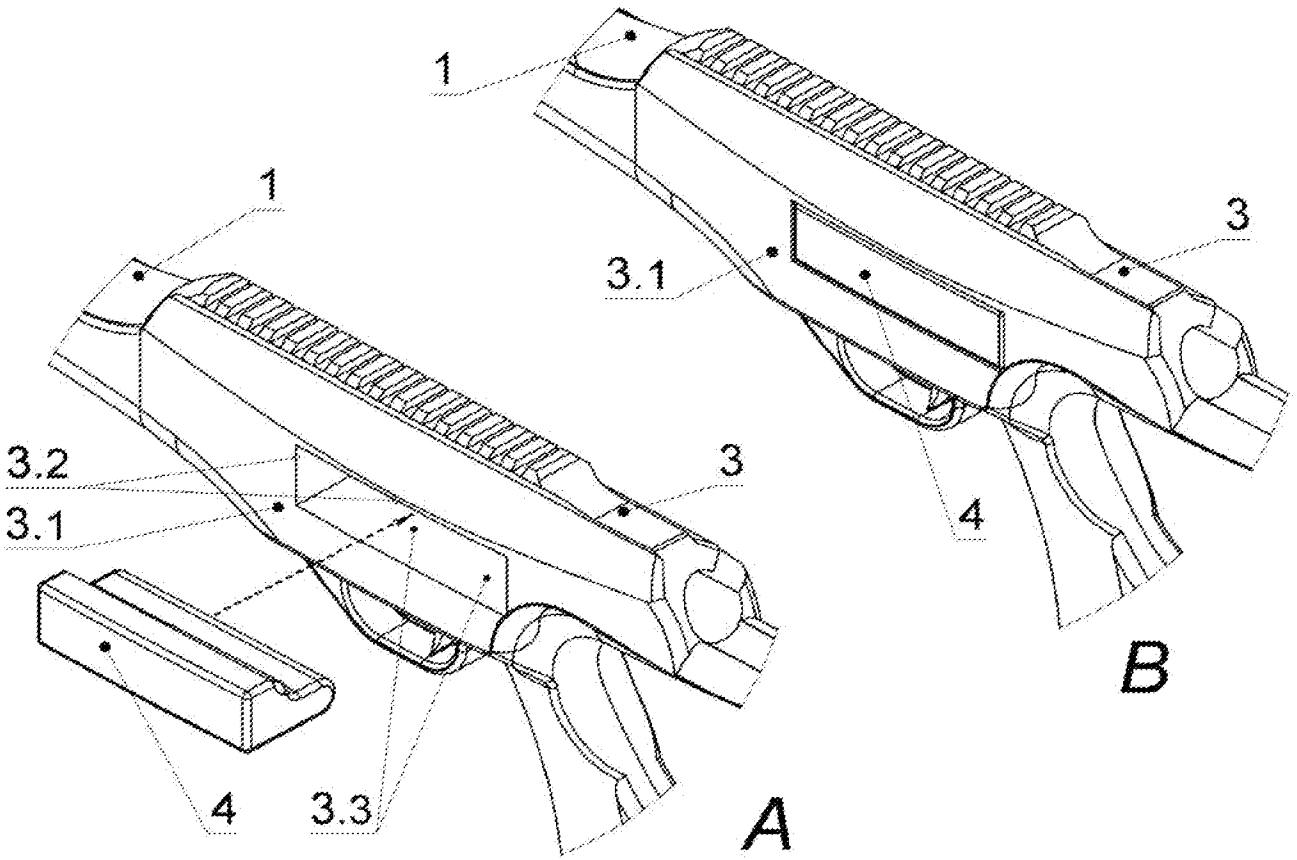
in FIG. 2—shows the diagram of placing the magazine in to the receptacle of the magazine, views A, B.
Figure 4:
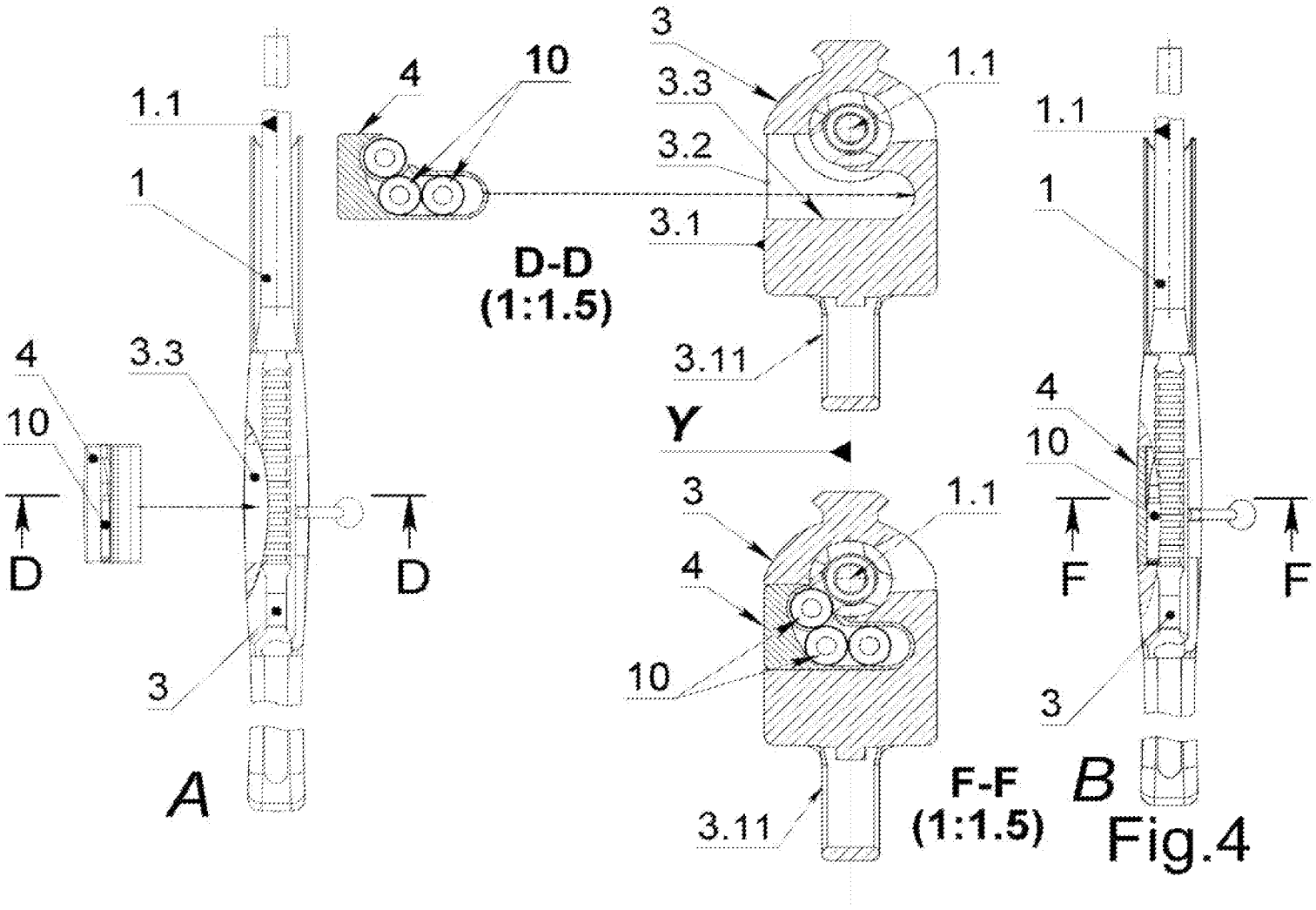
in FIG. 4—shows the proposed firearm and the process of placing the magazine in the firearm, views A, B, sections along D-D, F-F.

The process of placing the magazine 4 in to the receptacle of the magazine 3.3 through the hole 3.2 is shown in FIG. 2, view A and FIG. 4, view A, section D-D.

The receptacle of the magazine 3.3 (FIG. 3, 4) and the magazine 4 placed into it are located in the proposed firearm so that the vertical longitudinal plane Y passes through them, passing through the longitudinal axis 1.1 of the barrel 1.

Figure 5:
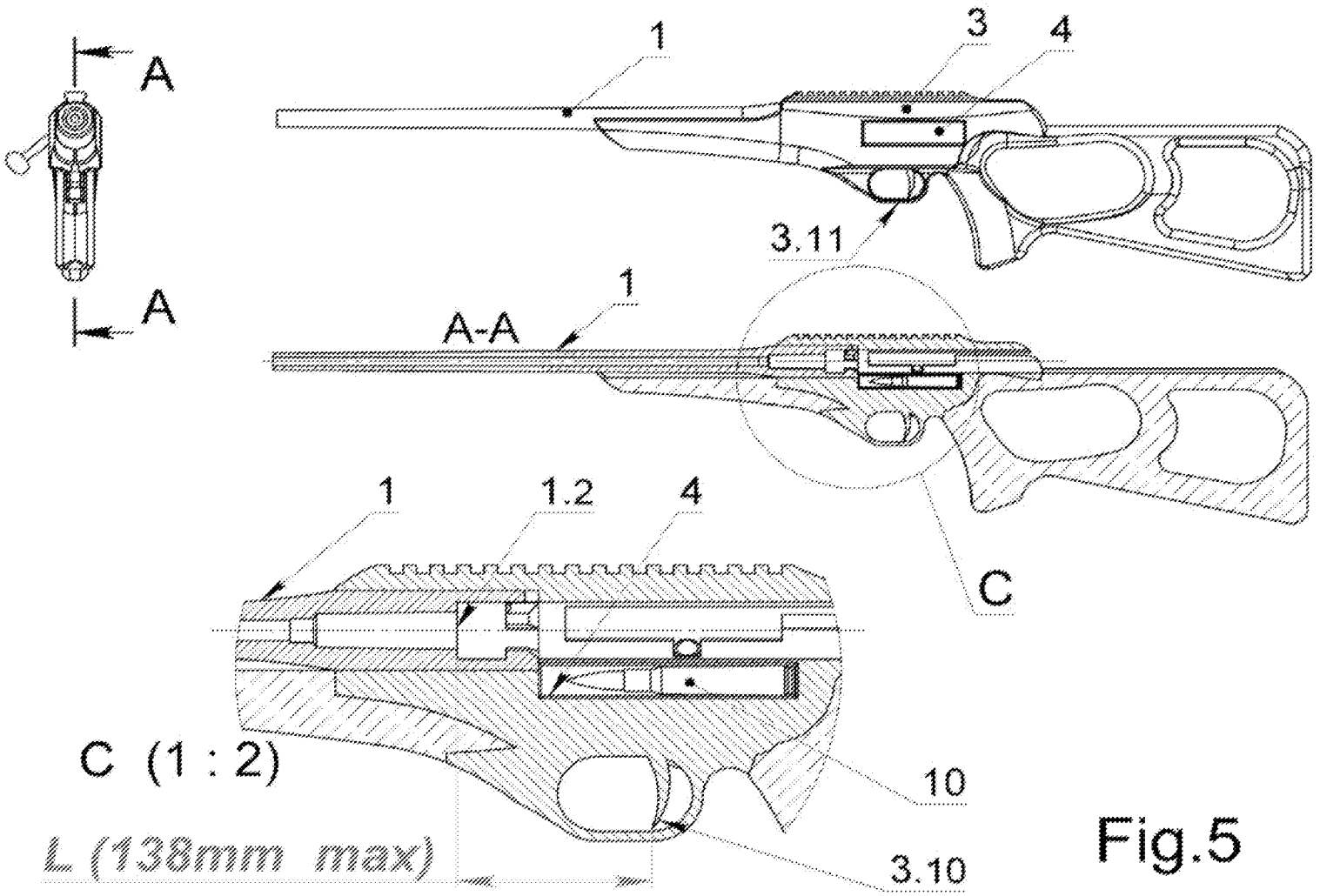
in FIG. 5—shows the appearance of the proposed firearm, section along A-A, local view C, showing the maximum removal of the breech end of the barrel from the trigger.

The maximum distance L (FIG. 5) from the trigger 3.10 to the breech end 1.2 of the barrel 1 is no more than 138 mm.

Figure 6:
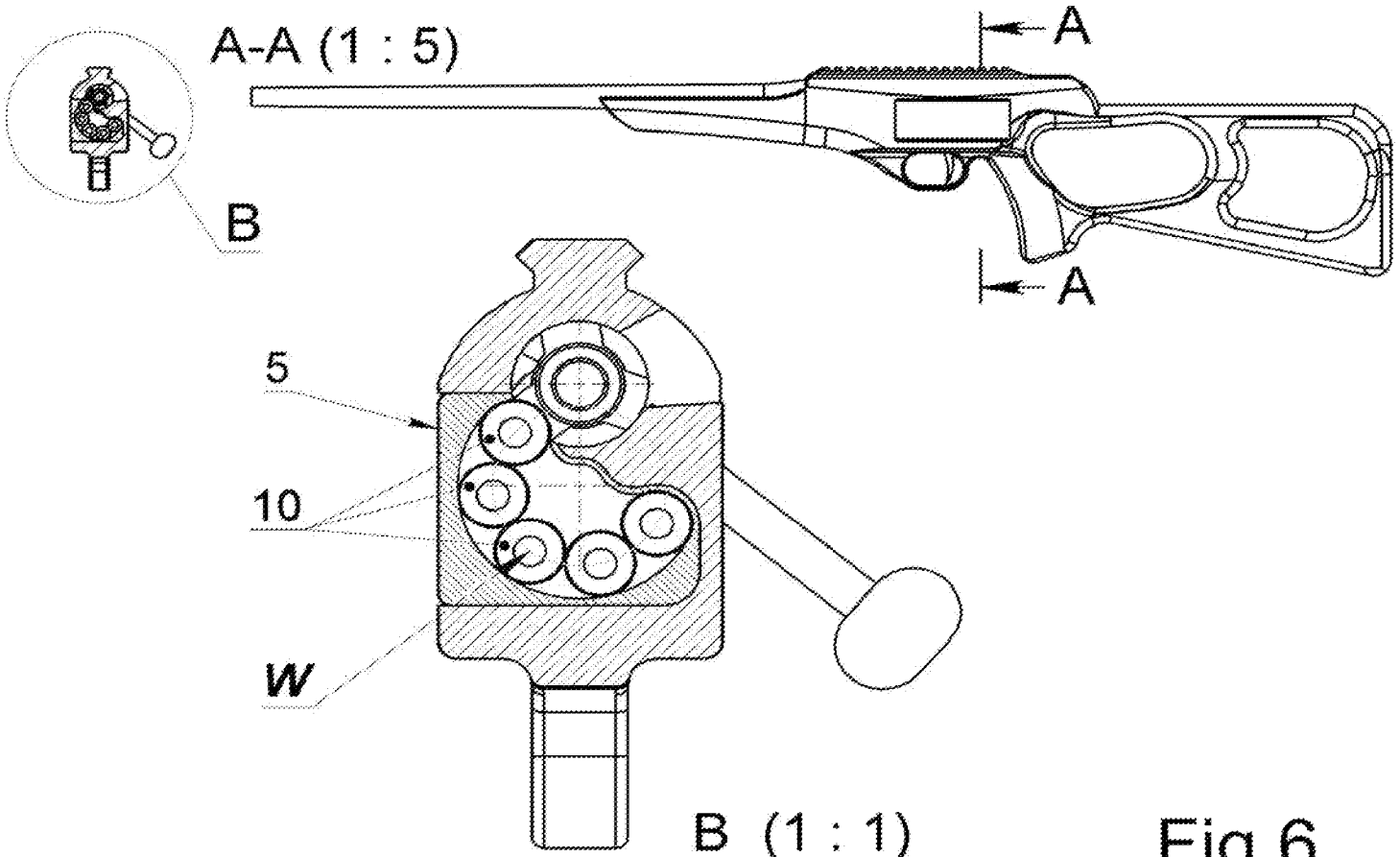
in FIG. 6—shows the appearance of the firearm, in the variant when the cartridges in the magazine are located along the circumference, section along A-A, appearance B.

The variant of the proposed firearm containing the magazine 5 (FIG. 6), in which the cartridges 10 are located along the circumference W.

The invention claimed is:

1. A firearm containing a barrel with a breech end, a receiver, a receptacle of a magazine, a trigger guard, a trigger, a replaceable magazine, characterized in that a side surface of the firearm contains a hole, through which the replaceable magazine is placed into the receptacle of the magazine, the receptacle of the magazine itself and placed into it magazine, are located over the trigger guard, and through them passes a vertical longitudinal plane, passing through a longitudinal axis of the barrel, wherein a distance from the trigger to the breech end of the barrel is no more than 138 mm.

2. The firearm, characterized according to claim 1, in that the cartridges in the magazine are located on the circumference.

* * * * *